US007339454B1

(12) United States Patent
Fleming

(10) Patent No.: US 7,339,454 B1
(45) Date of Patent: Mar. 4, 2008

(54) TENSILE-STRESSED MICROELECTROMECHANICAL APPARATUS AND MICROELECTROMECHANICAL RELAY FORMED THEREFROM

(75) Inventor: James G. Fleming, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 401 days.

(21) Appl. No.: 11/103,311

(22) Filed: Apr. 11, 2005

(51) Int. Cl.
*H01H 37/48* (2006.01)
*H01H 37/50* (2006.01)

(52) U.S. Cl. ..... 337/141; 337/123; 310/306; 310/307

(58) Field of Classification Search ..... 361/163; 310/306–309; 60/527–529; 347/54, 56, 347/57; 337/36, 139, 141, 333, 123
See application file for complete search history.

(56) References Cited

U.S. PATENT DOCUMENTS 4,544,988 A * 10/1985 Hochstein ..... 361/211
5,029,805 A * 7/1991 Albarda et al. ..... 251/11
5,058,856 A * 10/1991 Gordon et al. ..... 251/11
6,078,243 A * 6/2000 Barnes et al. ..... 337/140
6,140,903 A * 10/2000 Kalapodis et al. ..... 337/140
6,180,428 B1 * 1/2001 Peeters et al. ..... 438/22
6,239,685 B1 * 5/2001 Albrecht et al. ..... 337/365
6,567,448 B1 * 5/2003 Sun et al. ..... 372/50.1
6,703,916 B2 * 3/2004 Charvet et al. ..... 337/141
6,762,667 B2 * 7/2004 Volant et al. ..... 337/89
6,768,412 B2 * 7/2004 Becka et al. ..... 337/36
6,771,158 B2 * 8/2004 Lee et al. ..... 337/36
6,812,820 B1 * 11/2004 Fouillet ..... 337/333
6,877,316 B1 * 4/2005 Sarkar et al. ..... 60/527
6,911,891 B2 * 6/2005 Qiu et al. ..... 337/53
7,011,288 B1 * 3/2006 Slicker et al. ..... 251/11
7,012,491 B1 * 3/2006 Geisberger et al. ..... 335/78
2001/0010488 A1 * 8/2001 Minners ..... 337/131
2001/0026207 A1 * 10/2001 Stenzel et al. ..... 337/104
2003/0121260 A1 * 7/2003 Sinclair ..... 60/527
2003/0227361 A1 * 12/2003 Dickens et al. ..... 335/78
2004/0069608 A1 * 4/2004 Shimizu et al. ..... 200/512
2004/0074234 A1 * 4/2004 Howell et al. ..... 60/527
2004/0183632 A1 * 9/2004 Howell et al. ..... 335/78
2005/0073380 A1 * 4/2005 Howell et al. ..... 335/219
2006/0152328 A1 * 7/2006 Robert ..... 337/333

* cited by examiner

*Primary Examiner*—Anatoly Vortman
(74) *Attorney, Agent, or Firm*—John P. Hohimer

(57) ABSTRACT

A microelectromechanical (MEM) apparatus is disclosed which includes a shuttle suspended above a substrate by two or more sets of tensile-stressed beams which are operatively connected to the shuttle and which can comprise tungsten or a silicon nitride/polysilicon composite structure. Initially, the tensile stress in each set of beams is balanced. However, the tensile stress can be unbalanced by heating one or more of the sets of beams; and this can be used to move the shuttle over a distance of up to several tens of microns. The MEM apparatus can be used to form a MEM relay having relatively high contact and opening forces, and with or without a latching capability.

22 Claims, 14 Drawing Sheets

TENSILE-STRESSED MICROELECTROMECHANICAL APPARATUS AND MICROELECTROMECHANICAL RELAY FORMED THEREFROM

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates in general to microelectromechanical (MEM) devices, and in particular to a tensile-stressed MEM apparatus which can be used as a moveable stage, or to form a MEM relay. The tensile-stressed MEM apparatus of the present invention can be formed with or without a latching capability.

BACKGROUND OF THE INVENTION

Micromachining is an emerging technology for batch manufacturing many different types of mechanical and electromechanical devices on a microscopic scale using technology which was originally developed for fabricating integrated circuits (ICs). Micromachining generally avoids the use of built-in stress in a completed device since this can be detrimental to device operation.

The present invention relates to a tensile-stressed MEM apparatus wherein the tensile stress can be controlled and utilized to effect a lateral movement of a suspended shuttle (also termed herein a stage). The MEM apparatus of the present invention can be used, for example, to form a MEM relay, with switching of the MEM relay being produced by a change in the tensile stress therein. This change in the tensile stress can also be used to provide a latching capability for the MEM relay according to certain embodiments of the present invention.

These and other advantages of the present invention will become evident to those skilled in the art.

SUMMARY OF THE INVENTION

The present invention relates to a microelectromechanical (MEM) apparatus which comprises a substrate; and a shuttle suspended above the substrate by a plurality of sets of tensile-stressed beams. The tensile-stressed beams are located on at least two sides of the shuttle and operatively connected thereto, and with the shuttle being moveable in a direction substantially parallel to the substrate in response to a tensile stress in a first set of the tensile-stressed beams on one side of the shuttle upon heating a second set of the tensile-stressed beams on an opposite side of the shuttle and thereby reducing the tensile stress therein. One end of each tensile-stressed beam can be operatively connected to the shuttle, with an opposite end of each tensile-stressed beam being anchored to the substrate. The substrate can comprise silicon; and the shuttle can comprise a metal.

When the shuttle comprises a metal, one or more electrodes can be supported on the substrate, with the shuttle being moveable to contact at least one electrode to provide an electrical connection thereto in response to the second set of the tensile-stressed beams being heated to reduce the tensile stress therein. Heating of the tensile-stressed beams can be produced by a flow of an electrical current therein. A latch can also be provided in the MEM apparatus to maintain the electrical connection.

Each tensile-stressed beam can comprise tungsten or silicon nitride. When the tensile-stressed beams comprise tungsten, the beams can further comprise titanium nitride (e.g. provided as a layer over at least a portion of the tungsten). When the tensile-stressed beams comprise silicon nitride which is not electrically conductive, the beams can further comprise polycrystalline silicon for electrical conductivity. Each set of the tensile-stressed beams can be electrically isolated from the shuttle, as needed, by an electrically-insulating spacer (e.g. comprising silicon nitride) disposed therebetween.

The shuttle can comprise a mesh structure. A plurality of openings in the mesh structure can be optionally filled with a material (e.g. silicon nitride or polycrystalline silicon).

The present invention further relates to a MEM apparatus which comprises a substrate; a pair of electrodes supported on the substrate; and an electrically-conductive shuttle suspended above the substrate by a plurality of sets of tensile-stressed beams operatively connected to the shuttle. Each set of the tensile-stressed beams can be operatively connected to a different side of the shuttle. The shuttle, which can comprise a mesh structure, is moveable in a direction parallel to the substrate to electrically contact the pair of electrodes in response to a reduction in tensile stress in a first set of the tensile-stressed beams produced upon heating with an electrical current. Each tensile-stressed beam can comprise tungsten or silicon nitride.

The MEM apparatus can further comprise a latch for holding the electrically-conductive shuttle in contact with the pair of electrodes. The latch can be operated by heating a second set of the tensile-stressed beams to reduce the tensile stress therein. The latch can also be made operable to release the electrically-conductive shuttle from contact with the pair of electrodes by heating a third set of the tensile-stressed beams to reduce the tensile stress therein. Each set of the tensile-stressed beams can be electrically isolated from the shuttle by an electrically-insulating spacer located therebetween.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1:
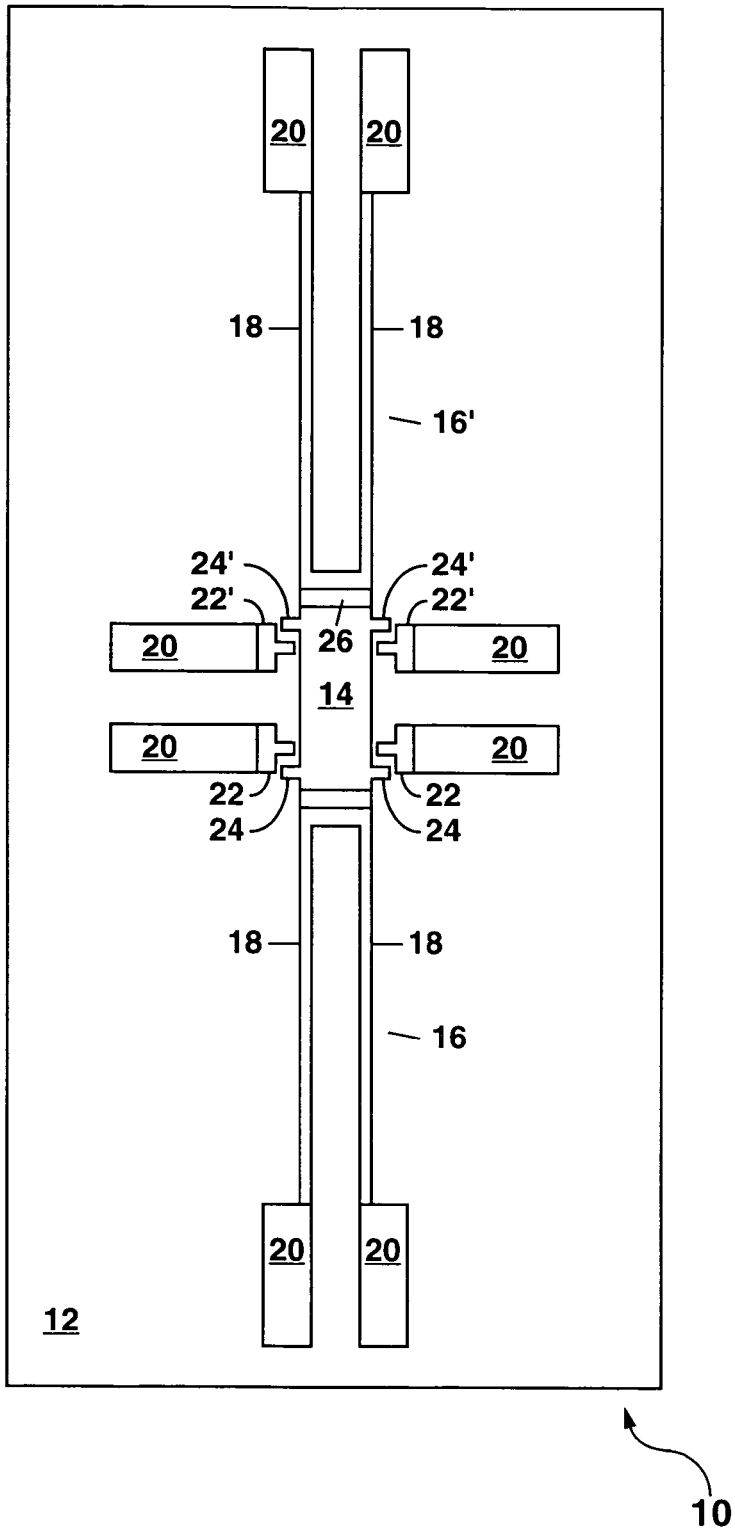
FIG. 1 shows a schematic plan view a first example of the MEM apparatus of the present invention in an as-fabricated position.
Figure 2:
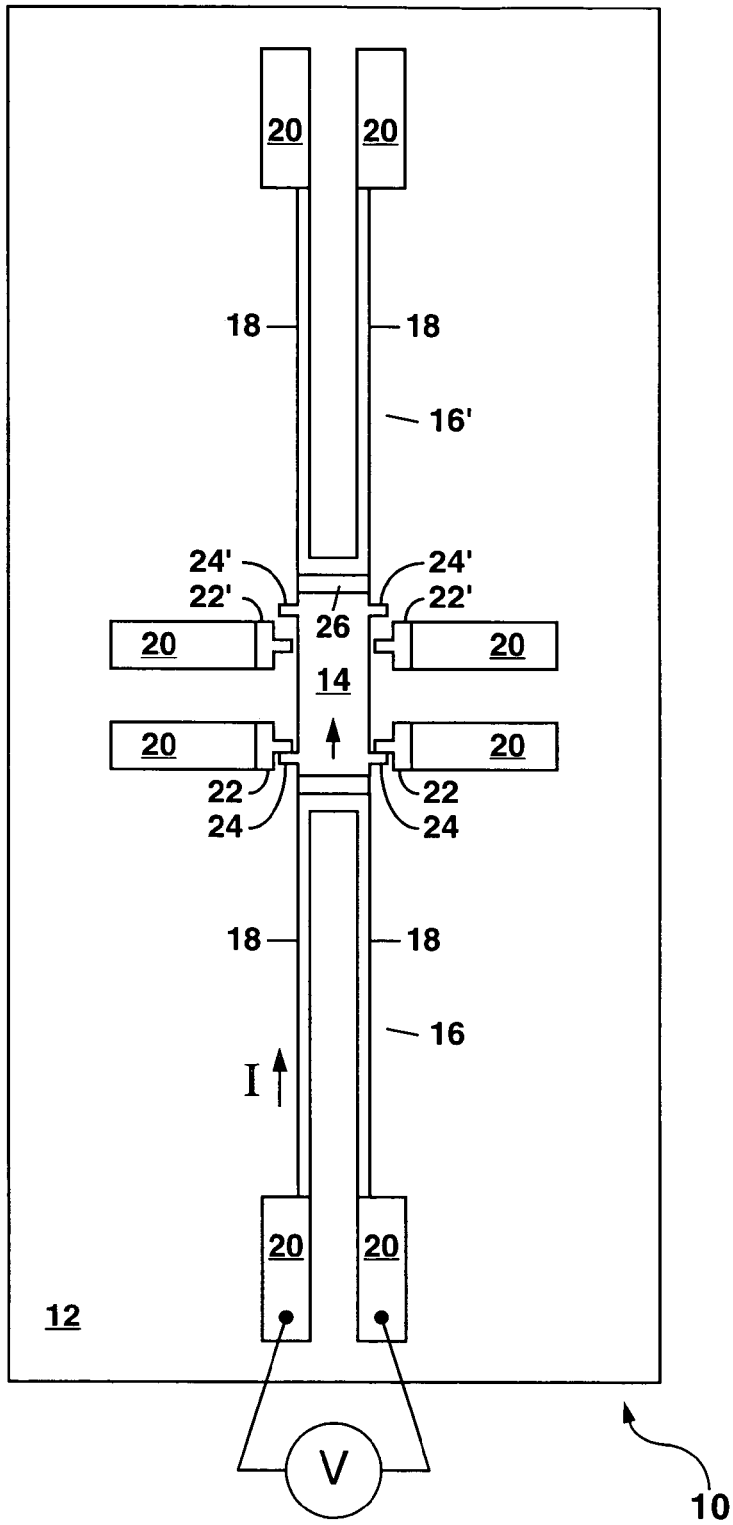
FIG. 2 shows a schematic plan view of the device of FIG. 1 with a first set of the tensile-stressed beams being actuated by a voltage, V, and current, I, to move the shuttle in the direction indicated by the arrow on the stage, thereby making an electrical connection between a pair of electrodes on the stage and another pair of electrodes supported on the substrate.

Referring to FIG. 1, there is shown schematically in plan view a first example of the MEM apparatus 10 of the present invention. The MEM apparatus 10 comprises a substrate 12 having a shuttle 14 suspended above the substrate 12 by two sets 16 and 16' of tensile-stressed beams 18. In the example of FIGS. 1 and 2, each set 16 and 16' of the tensile-stressed beams 18 can be considered to be formed from a single folded beam 18, or alternately from a pair of substantially straight beams connected together by a cross-beam. The two sets 16 and 16' of tensile-stressed beams 18 are operatively connected to opposite sides of the shuttle 14, with a tensile stress built into the beams 18 being initially balanced to suspend the shuttle 14 in the position shown (i.e. an as-fabricated position). Thus, the shuttle 14 in FIG. 1 is in a metastable equilibrium due to balancing of opposing forces provided by each tensile-stressed beam 18 which is operatively connected to the shuttle 14.

Unbalancing the tensile stress by reducing the tensile stress in one set 16 or 16' of beams 18 will upset the metastable equilibrium and urge the shuttle 14 towards the other set 16' or 16 having the higher tensile stress, with the shuttle 14 moving up to about 5 microns or more until the forces acting upon the shuttle 14 are again balanced. This can be seen in FIG. 2 which shows the shuttle 14 moving substantially parallel to the substrate 12 in the direction indicated by the vertical arrow on the shuttle 14 when the tensile stress in the set 16 of beams 18 is reduced by electrically heating the set 16 of beams 18 which are electrically conductive. The electrical heating produces a thermal expansion of the set 16 of beams 18, thereby reducing the tensile stress in this set 16 of beams 18. The other set 16' of beams 18, which is not heated and has a larger tensile stress pulls on the shuttle 14 and displaces the shuttle 14 by a distance sufficient to equalize the opposing forces produced by the tensile stress in the two sets 16 and 16' of beams.

Resistive heating of the beams 18 of set 16 can be done by connecting an external voltage source, V, to a pair of contact pads 20 which are connected to one end of the beams 18 in the set 16. The voltage source, V, provides an electrical current, I, that resistively heats the set 16 of beams 18, thereby thermally expanding the beams 18 and reducing the tensile stress therein. The contact pads 20, which can be electrically isolated from the substrate 12, can also be used to firmly anchor one end of each beam 18 to the substrate 12.

In the example of FIGS. 1 and 2, a pair of electrodes 22 are disposed about each end of the shuttle 14 to contact another pair of electrodes 22' on the shuttle 14. Each electrode 22 and 22' is generally located in the same plane as the shuttle 14, with the electrodes 22 each being connected to a contact pad 20 and suspended above the substrate 12. The shuttle 14 is electrically conductive and comprises a metal (e.g. tungsten). Movement of the shuttle 14 as shown in FIG. 2 provides an electrical contact (i.e. a switch closure) between the electrodes 22 and 24 on each side of the shuttle 14, thereby completing an electrical circuit between the two contact pads 20 connected to the electrodes 22.

Removing or switching off the external voltage source, V, allows the set 16 of beams 18 to cool down to room temperature. This restores the tensile stress in the beams 18 of set 16 to an initial as fabricated level, and urges the shuttle 14 back to an initial as-fabricated position as shown in FIG. 1. Connecting the voltage source, V, to the other set 16' of tensile-stressed beams 18 will reduce the tensile stress in these beams 18 and will move the shuttle 14 in the opposite direction due to the higher tensile stress in the set 16 of beams 18. This movement of the shuttle 14 will provide a switch closure between the electrodes 22' and 24' on each side of the shuttle 14.

In the example of FIGS. 1 and 2, the shuttle 14 is electrically isolated from the tensile-stressed beams 18 by an intervening electrically-insulating spacer 26 which connects each set 16 and 16' of the beams 18 to the shuttle 14. The electrically-insulating spacer 26 can comprise, for example, silicon nitride.

Figure 3:
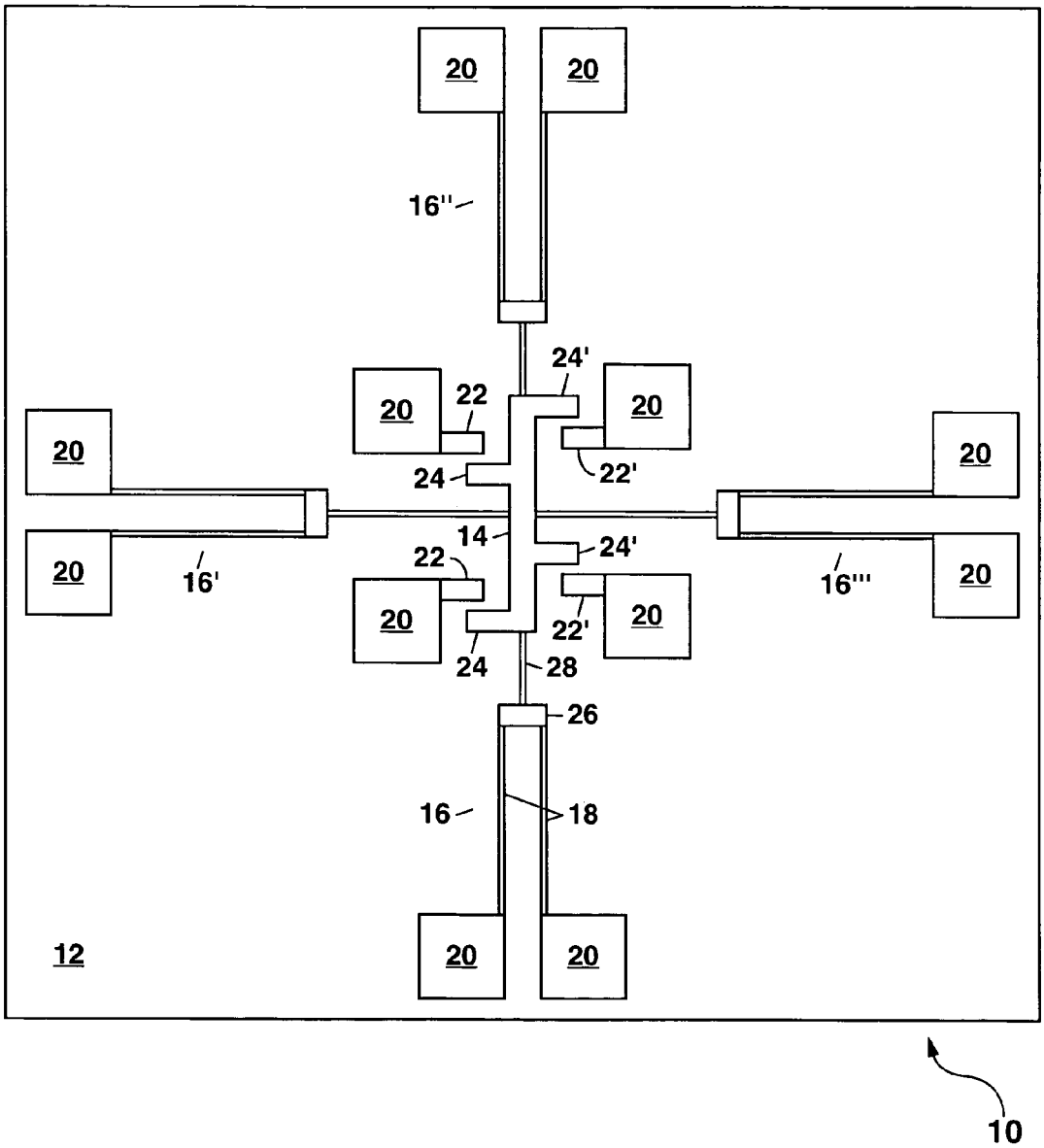
FIG. 3 shows a schematic plan view of a second example of the MEM apparatus of the present invention in an as-fabricated position.

FIG. 3 shows a second example of the MEM apparatus 10 of the present invention. This example of the present invention can be used, for example, to form a MEM relay having a latching capability.

In FIG. 3, a shuttle 14 is provided suspended over a substrate 12 by a plurality of sets 16, 16', 16" and 16'" of tensile-stressed beams 18 located on different sides of the shuttle 14 and operatively connected thereto to move the shuttle 14 in different directions. One end of each tensile-stressed beam 18 is electrically connected to a contact pad 20 and anchored to the substrate 12. The other end of each tensile-stressed beam is connected to the shuttle 14 through an electrically-insulating spacer 26 and a linkage 28. By controlling and varying the tensile stress in each set 16, 16', 16" and 16'" of tensile-stressed beams 18 one or more pairs of electrodes 22 supported on the substrate 12 can be made to electrically contact adjacent electrodes 24 on the shuttle 14.

Each tensile-stressed beam 18 in the examples of FIGS. 1 and 3 can have a length of, for example, 2-6 millimeters, a thickness of 6 μm, and a width of 0.8 μm. The linkages 28 in FIG. 3 can each be, for example, 200-500 μm long with the same thickness and width as the beams 18. The contact pads 20 in FIG. 3 can be, for example, 100 μm on a side. In FIGS. 1 and 3, the shuttle 14 can be, for example, 50-200 μm wide, 0.1-1 millimeters long, and 6 μm thick.

By heating the set 16 of tensile-stressed beams 18 with an applied voltage, V, the tensile stress in this set of beams 18 can be reduced so that the opposing set 16" of beams 18 pulls the shuttle in a direction towards the set 16". This will bring the electrodes 24 on the shuttle 14 into contact with the electrodes 22 in a manner similar to that previously described with reference to FIG. 2. Similarly, by connecting the voltage, V, to heat the set 16" of tensile-stressed beams 18 and reduce the tensile stress therein with no voltage being applied to the set 16 of beams 18, the shuttle 14 can be moved in the opposite direction. This will provide a contact between the electrodes 22' and 24'. In each case, the contact force can be made relatively high—up to 20 milliNewtons or more—with the exact contact force being determined by a difference in the tensile stress in the two opposing sets 16 and 16' beams 18 produced by the applied voltage, V. In each case above, the contact between the electrodes 22 and 24 and the electrodes 22' and 24' will also be maintained only so long as the voltage, V, is applied. Upon removal of the applied voltage, V, an opening force for disengaging the electrodes 22 and 24 or 22' and 24' will be about the same as the contact force.

In the device 10 of FIG. 3, a latching capability is also provided so that the electrodes 22 and 24 or the electrodes 22' and 24' can be latched in place. This is advantageous to eliminate a need to continuously apply the voltage, V, to one or the other of the sets 16 and 16" of tensile-stressed beams 18. This latching capability will now be described with reference to FIGS. 4-6.

Figure 4:
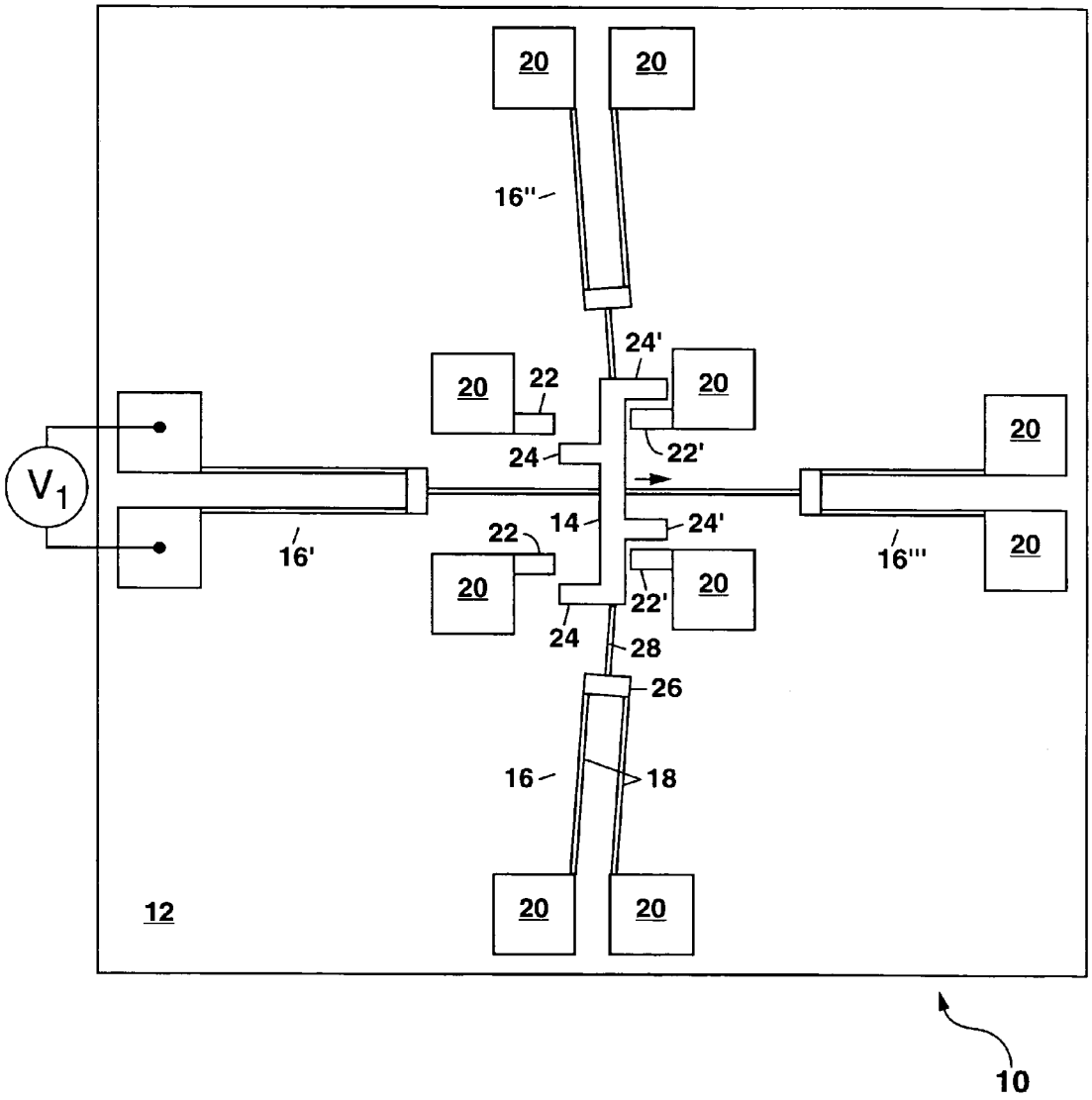
FIGS. 4-6 illustrate latching of the device of FIG. 3 by actuating two sets of the tensile-stressed beams in sequence. The arrow in each figure indicates the direction of movement of the stage.

In FIG. 4, to initiate a series of movements of the shuttle 14 for latching of the electrodes 22 and 24, the set 16' of tensile-stressed beams 18 is heated with an applied voltage, $V_1$. This reduces the tensile stress in the set 16' of beams 18 so that the tensile stress in the opposing set 16''' of beams 18 pulls the shuttle 14 to the right as indicated by the horizontal arrow in FIG. 4. The exact distance that the shuttle 14 moves to the right will be determined by the magnitude of the applied voltage $V_1$ and an initial stress state, and can be, for example, 5-30 μm. The applied voltage, $V_1$, can be, for example, 0.7-2 volts when the beams 18 comprise tungsten, with the electrical current, I, being 50-150 milliAmps. The overall electrical power required to heat the beams 18 of set 16' can be, for example, 50-120 milliwatts. In general, the shuttle 14 will be moved to the right by a distance that results in the tensile stress in both sets 16' and 16''' of beams 18 being substantially equalized while taking into account restoring forces produced by bending of the remaining sets 16 and 16" of beams 18 and the linkages 28 connected thereto.

Figure 5:
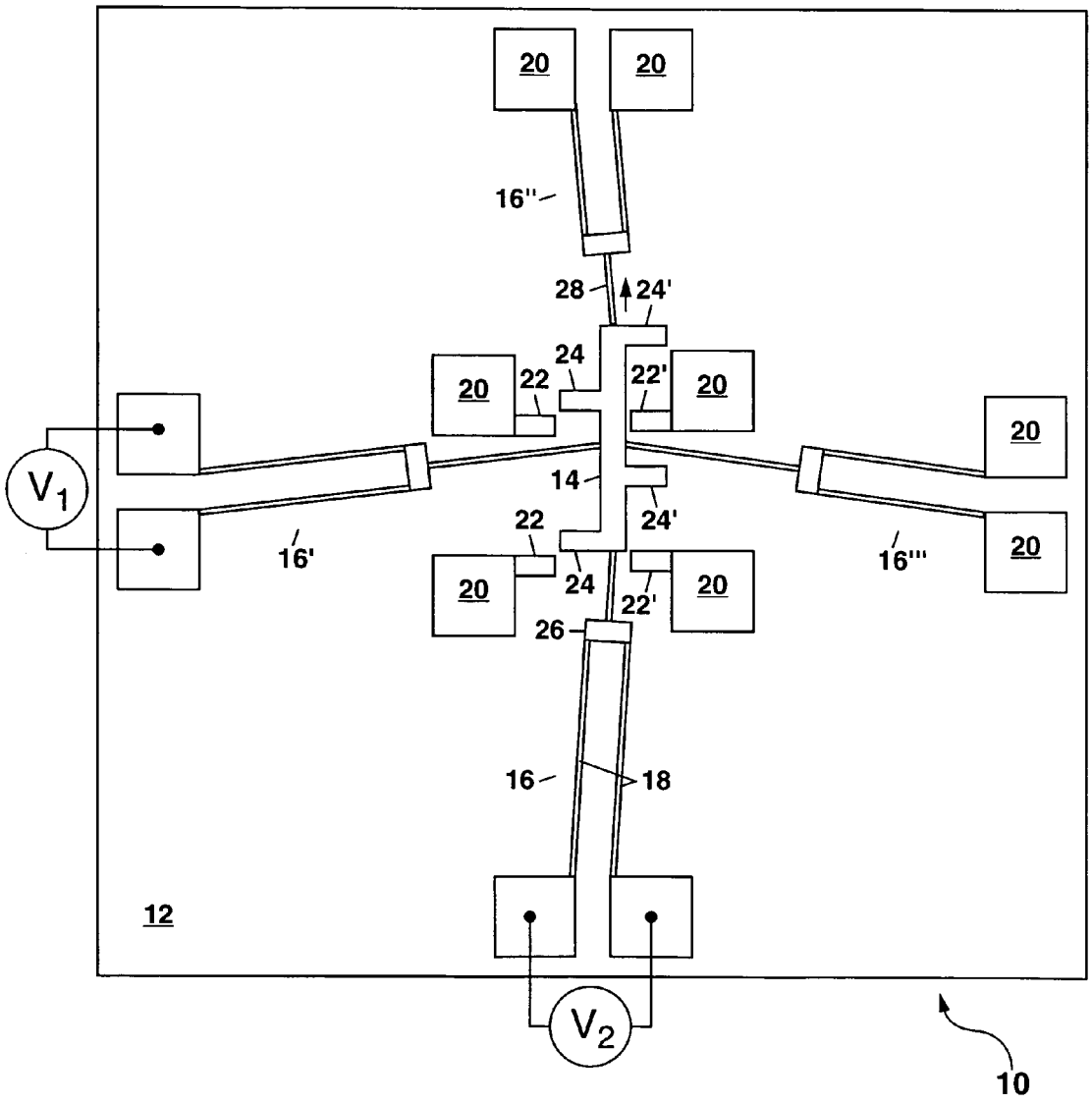

In FIG. 5, with the voltage $V_1$ still applied to the set 16' of beams 18, a second voltage, $V_2$, can be applied to the set 16 of tensile-stressed beams 18 to heat this set of beams 18 and reduce the tensile stress therein. When this is done, the opposing set 16" of beams 18 pulls the shuttle 14 laterally in the direction indicated by the vertical arrow in FIG. 5. This moves the electrodes 24 on the shuttle 14 past the electrodes 22 supported on the substrate 12. The voltage $V_2$, electrical current and electrical power required to heat the set 16 of tensile-stressed beams 18 can be about the same as that described above with reference to FIG. 4. Additionally, although not shown in FIGS. 3-5, a plurality of stops and/or guides can be built up on the substrate 12 to limit the extent of motion of the shuttle 14 and prevent an unwanted electrical contact between the shuttle 14 and the electrodes 22' or a premature contact between the electrodes 22 and 24.

Figure 6:
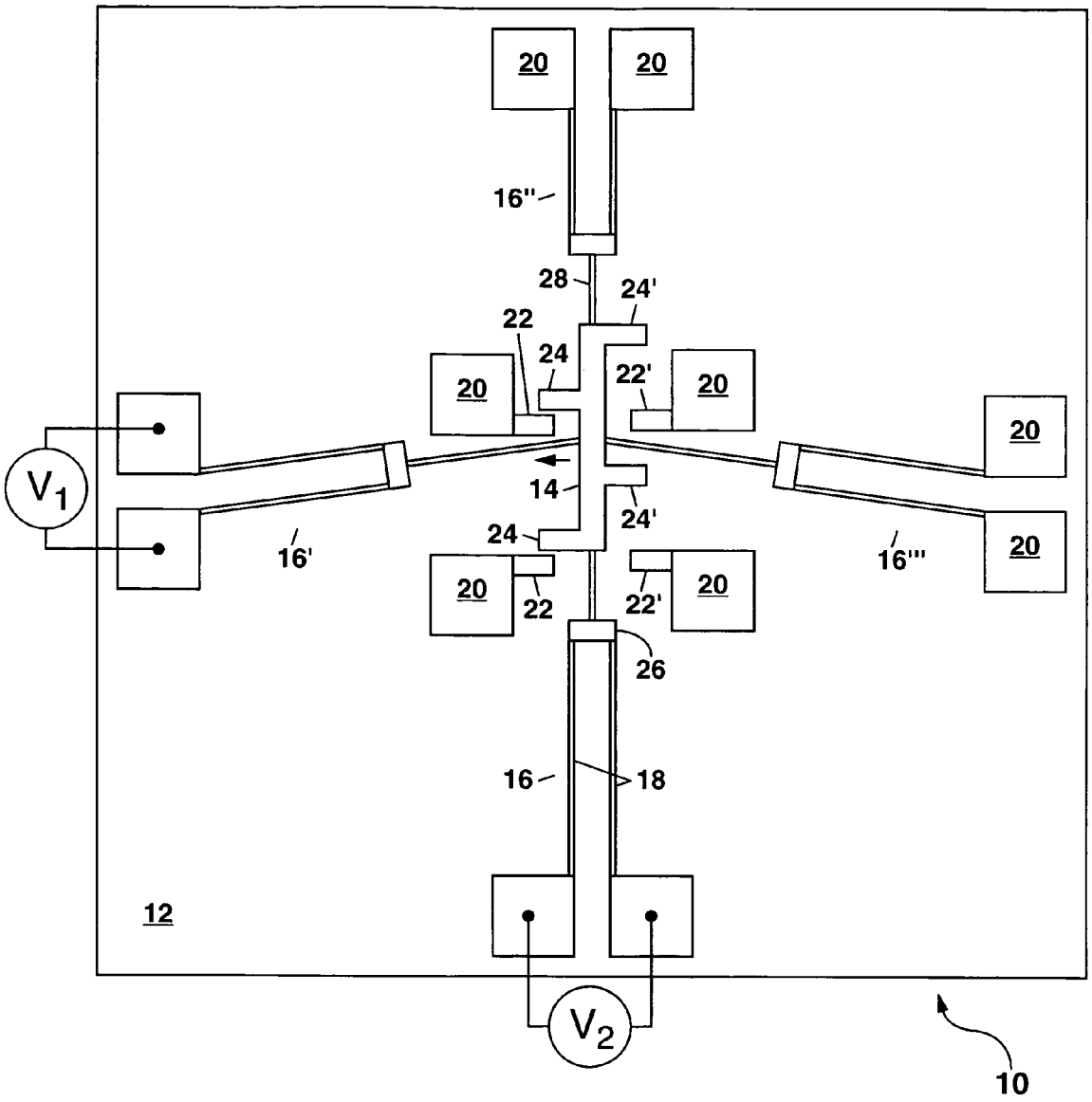

In FIG. 6, the voltage $V_1$ can now be reduced or switched off with the voltage $V_2$ still applied. This cools down the set 16' of tensile-stressed beams 18 thereby increasing the tensile stress therein. The increased tensile stress in the set 16' of beams 18 pulls the shuttle back to the left as indicated by the horizontal arrow. This moves the electrodes 24 on the shuttle 14 past the electrodes 22 on the substrate 12. The voltage $V_2$ can now be reduced or switched off to pull the shuttle 14 downward (i.e. towards the set 16 of beams 18) and latch the electrodes 24 on the shuttle 14 against the electrodes 22 on the substrate 12. The contact between the electrodes 22 and 24 can now be maintained without the need for any applied actuation voltages. The relatively high contact force produced by the tensile-stressed beams 18 is advantageous to reduce a contact resistance between the latched electrodes 22 and 24, and to allow the use of relatively hard metals for the electrodes 22 and 24 thereby reducing the possibility for adhesion (also termed stiction).

To unlatch the electrodes 22 and 24, the sequence of applying the voltages $V_1$ and $V_2$ can be reversed. In unlatching the electrodes 22 and 24, the tensile-stressed beams 18 can also provide a relatively high opening force thereby overcoming any stiction of the electrodes 22 and 24.

In the example of FIGS. 3-6, a second set of electrodes 22' and 24' can also be latched by applying the voltage $V_1$ to the set 16''' of tensile-stressed beams 18 and the voltage $V_2$ to the set 16" of beams 18 in the order previously described with reference to FIGS. 4-6 since the device of FIGS. 3-6 has rotational symmetry.

Figure 7:
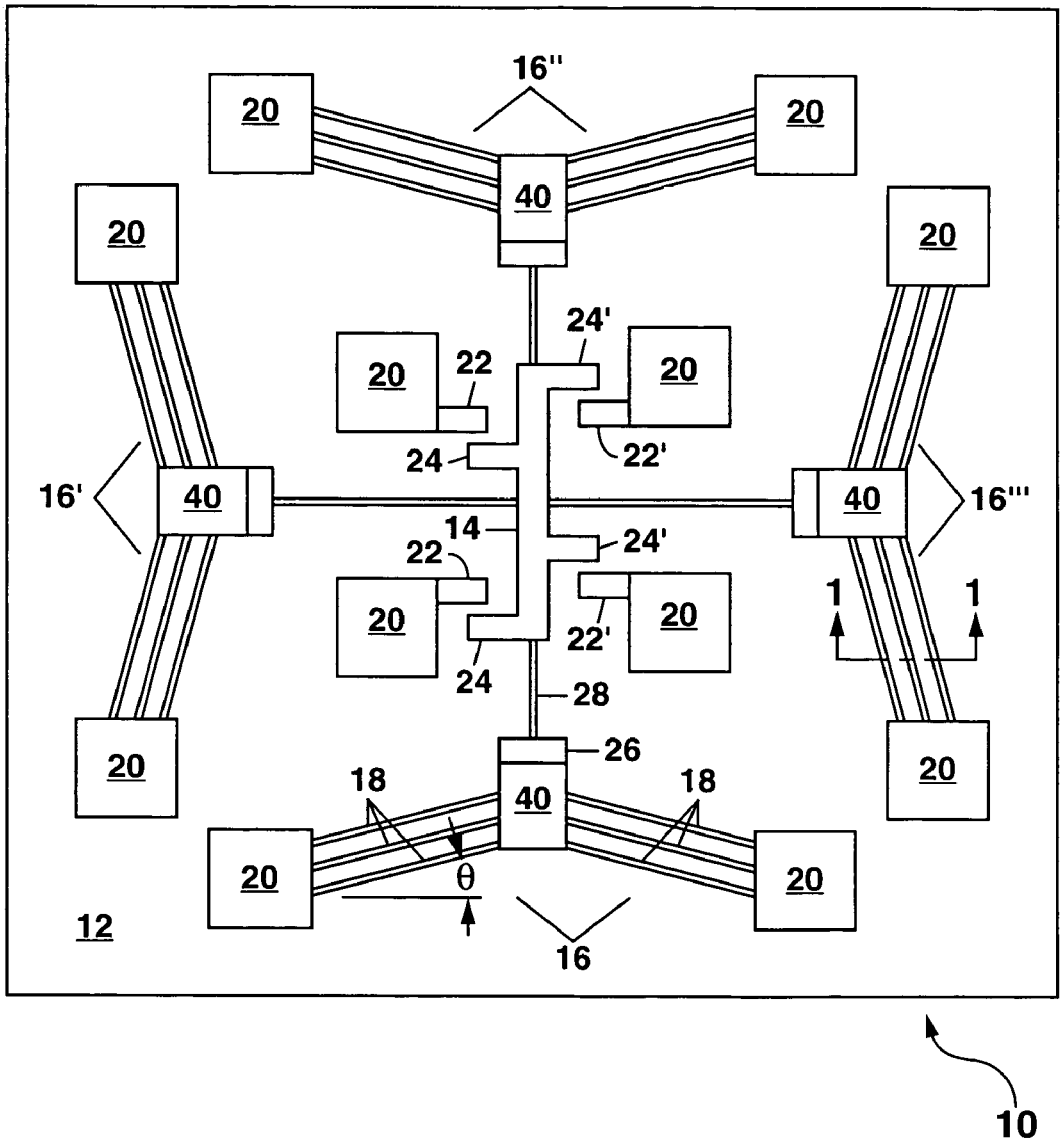
FIG. 7 shows a schematic plan view of a third example of the MEM apparatus of the present invention.

FIG. 7 shows a schematic plan view of a third example of the MEM apparatus 10 of the present invention which can be used as a MEM latching relay. This example of the MEM apparatus 10 is similar to that of FIG. 3 except that the various sets 16, 16', 16" and 16''' of tensile-stressed beams 18 are not oriented parallel to the linkages 28. This arrangement with the tensile-stressed beams 18 oriented at an angle to the linkages 28 can save space on the substrate 12. Additionally, in this arrangement the tensile-stressed beams 18 can provide a leveraged action which provides a magnified displacement of the shuttle 14 for a given change in length of each tensile-stressed beam 18 as compared with the device 10 of FIG. 3.

In the example of FIG. 7, the tensile-stressed beams 18 can be, for example, 0.5-1 millimeter long, 6 μm thick and 0.8 μm wide. An angle, θ, of the tensile-stressed beams 18 from a line drawn between the two contact pads 20 connected thereto can be, for example, 1-4 degrees in an as-fabricated position as shown in FIG. 7. The tensile stress in a set 16 of beams 18 acts to reduce the angle θ when this set 16 of beams 18 is not heated, and an opposing set 16" of beams 18 is being heated. The angle θ in the set 16" of beams 18 being heated increases since this set 16" of beams 18 is being pulled upon by the opposing set 16 due to the unbalanced tensile stress.

Since each beam 18 is tensile-stressed, the forces exerted on the various linkages 28 are always "pulling" in nature. This "pulling" force is produced in each set 16, 16', 16" or 16''' of tensile-stressed beams 18 which is not electrically activated by an applied voltage in response to the electrical activation of an opposing set of beams 18. This is exactly the opposite of a conventional bent-beam thermal actuator where the force is "pushing" in nature, and requires that the thermal actuator be electrically activated.

The "pulling" force produced by each set 16, 16', 16" or 16'" of tensile-stressed beams 18 in the MEM apparatus 10 of the present invention also allows the use of linkages 28 which can have a relatively small cross-section size to produce a sizeable "pulling" force on the order of 1 milliNewton since there is no possibility for the linkages 28 to buckle. To the contrary, the conventional thermal actuator requires a more substantial linkage since the "pushing" force could otherwise lead to a buckling of the linkage.

The examples of the present invention described heretofore can be formed by surface micromachining using tungsten to form the tensile-stressed beams 18 and other elements of the MEM apparatus 10. To form the MEM device 10 using tungsten, the process described hereinafter with reference to FIGS. 8A-8H can be used. This process, which is referred to as a molded tungsten process (also referred to herein as a damascene process), will be illustrated with a series of schematic cross-section views taken along the section line 1-1 in FIG. 7.

Figure 8A:
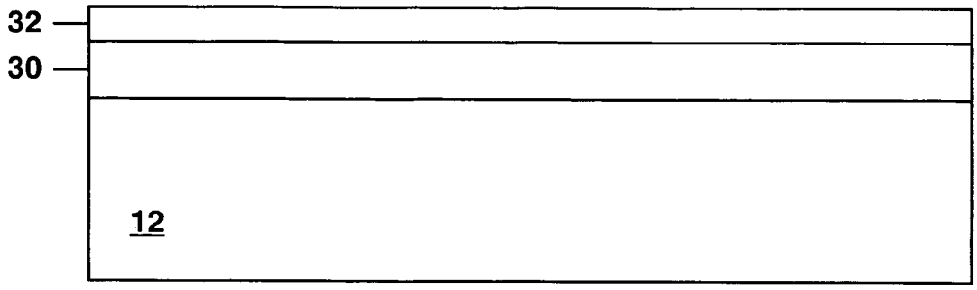
FIGS. 8A-8H show a series of schematic cross-section views along the section line 1-1 in FIG. 7 to illustrate fabrication of the various examples of the MEM apparatus using a molded tungsten damascene process.

In FIG. 8A, the substrate 12 can comprise silicon and can be initially prepared by forming a 2-μm thick layer 30 of a thermal oxide over the substrate 12, followed by a blanket deposition of a 1-μm thick layer 32 of PETEOS. PETEOS is a silicate glass formed from the decomposition of tetraethylortho silicate, also termed TEOS, by a plasma-enhanced chemical vapor deposition (PECVD) process.

Figure 8B:
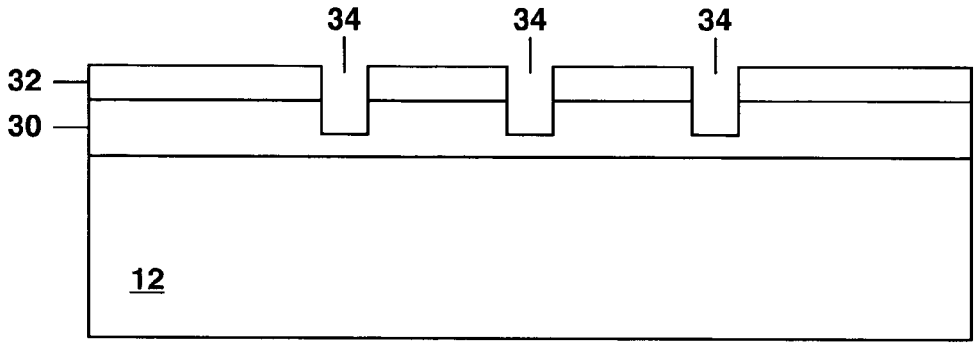

In FIG. 8B, a plurality of openings 34, which can be of arbitrary shape including trenches and intersecting trenches, are etched into the layers 30 and 32 of the thermal oxide and PETEOS, respectively, at locations wherein tungsten is to be deposited to build up the structure of the MEM apparatus 10. This can be done using a photolithographically-defined etch mask (not shown) and reactive ion etching.

Figure 8C:
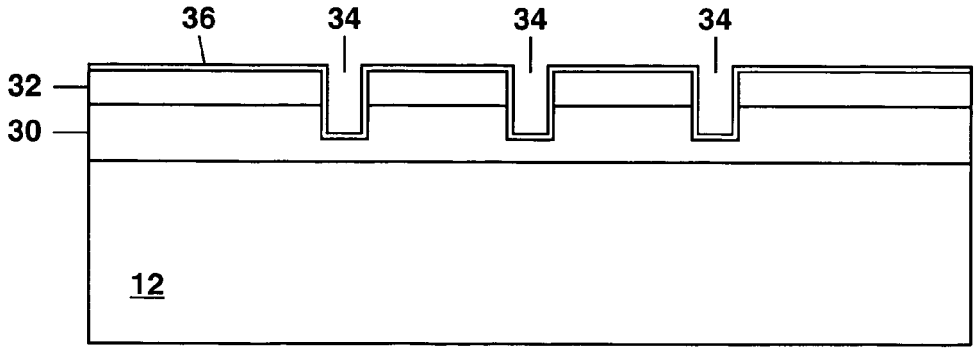

In FIG. 8C, a 20-50 nanometer thick layer 36 of titanium nitride (TiN) can be blanket deposited over the substrate 12 and in the openings 34 using a sputter deposition process. The TiN layer 36 serves as an adhesion layer since tungsten does not stick or nucleate well on the thermal oxide and PETEOS layers which are essentially silicon dioxide. The TiN layer 36 also forms a contacting surface for each electrode 22 and 24. Additionally, the TiN layer 36 is compressively stressed and, together with the thermal oxide and PETEOS layers which are also compressively stressed, helps to compensate for a high level of tensile stress in one or more subsequently-deposited tungsten layers 38, thereby significantly reducing any bowing of the substrate 12 during fabrication of the MEM device 10. Forming certain elements of the MEM apparatus 10 with a mesh structure as will be described hereinafter (see FIGS. 9 and 10) also helps to provide stress compensation during fabrication of the MEM apparatus 10.

Figure 8D:
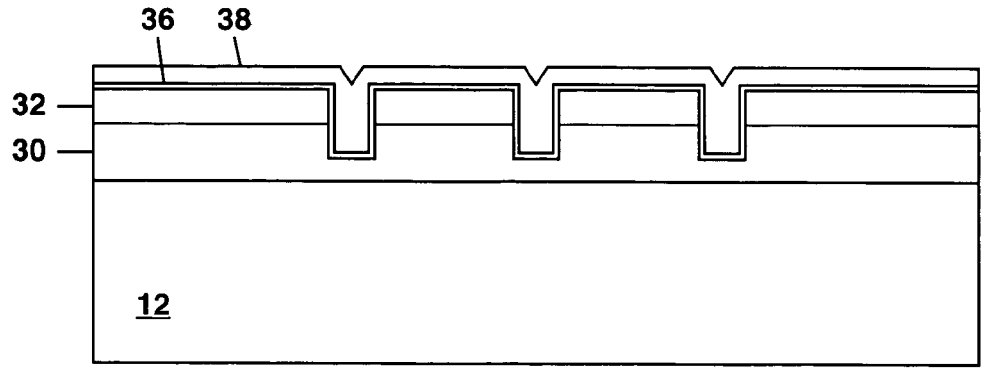

In FIG. 8D, a layer 38 of tungsten is blanket deposited over the substrate 12 by chemical vapor deposition to fill in the openings 34. The tungsten layer 38 can be up to about 0.8 μm thick and can be deposited at a temperature of about 400° C.

After deposition of the tungsten layer 38, the tungsten and TiN outside the openings 34 can be removed by a chemical-mechanical polishing (CMP) process step. This planarizes the substrate 12 as shown in FIG. 8E.

Figure 8E:
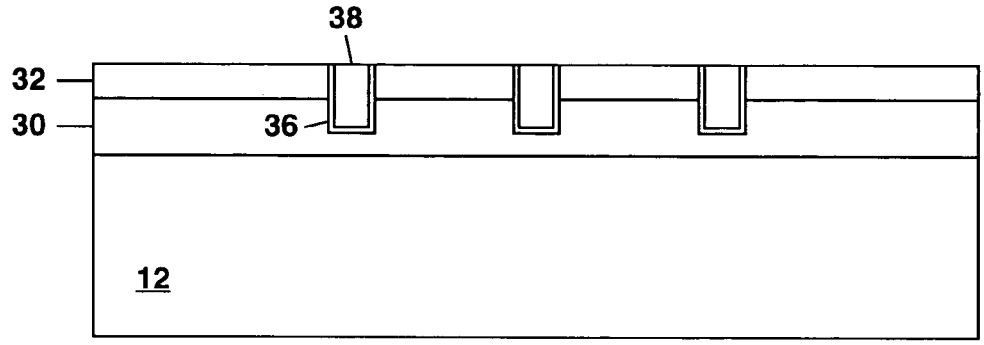
Figure 8F:
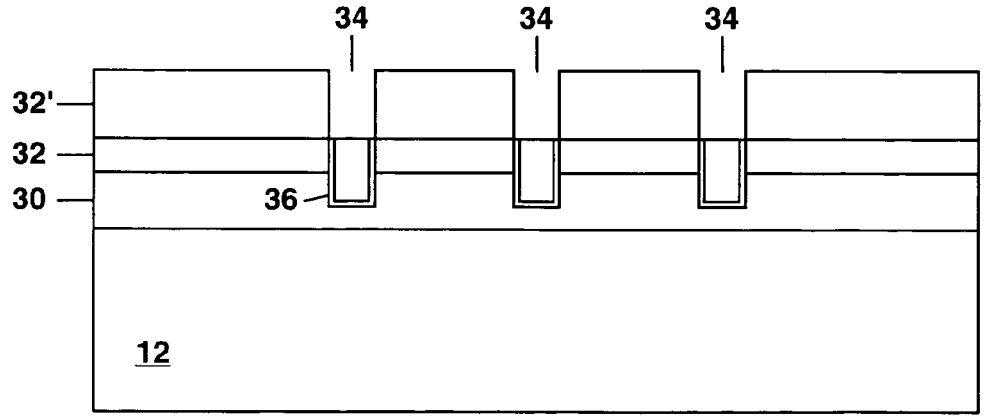

In FIG. 8F, another layer 32' of PETEOS about 2-μm thick can be blanket deposited over the substrate and patterned with a photolithographically-defined etch mask and reactive ion etching to form a plurality of openings 34 therein at locations wherein another layer of tungsten is to be deposited to further build up elements of the MEM apparatus 10 as needed.

Figure 8G:
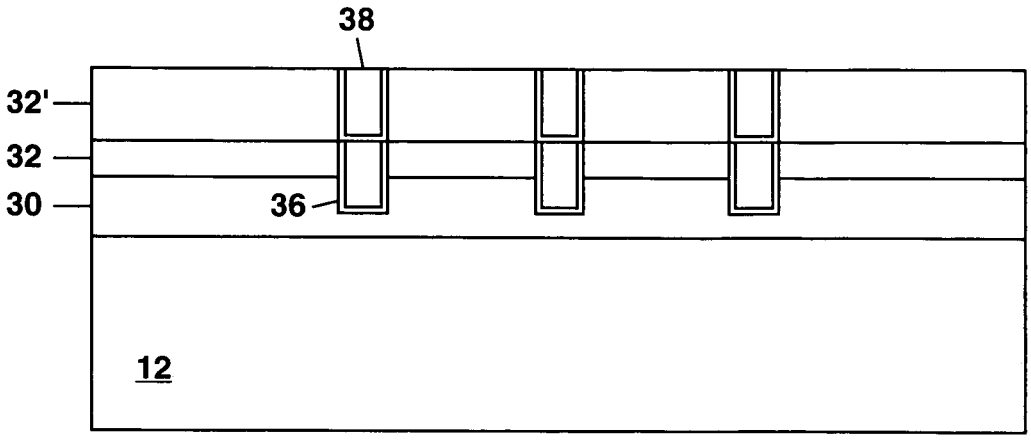

The steps in FIGS. 8C-8E can then be repeated to deposit additional layers 36 and 38 of TiN and tungsten, respectively, and then to remove any of these layers 36 and 38 extending outside of the openings 34 as shown in FIG. 8G. This process can be repeated several times, as needed, to build up the structure of the MEM apparatus 10.

Figure 8H:
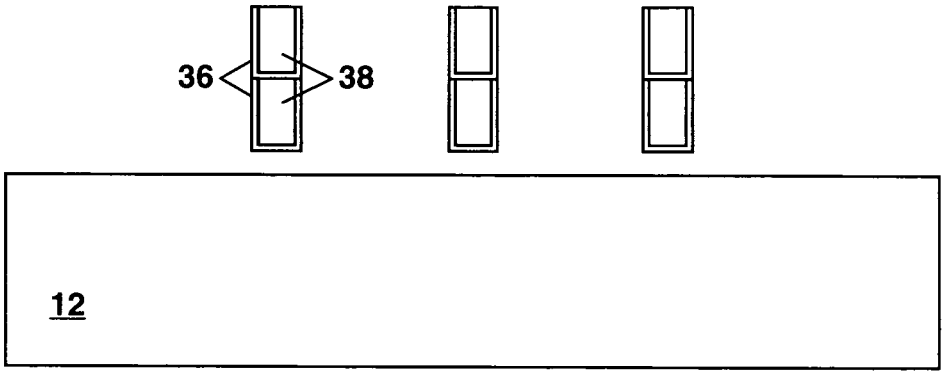

In FIG. 8H, the various layers of thermal oxide and PETEOS can be etched away by immersing the substrate 12 into a selective wet etchant comprising hydrofluoric acid (HF) which does not substantially chemically attack the TiN and tungsten, the substrate 12 and any elements of the apparatus 10 which may be made of silicon nitride or polycrystalline silicon (also termed polysilicon). This releases the MEM apparatus 10 so that the shuttle 14 is suspended above the substrate 12 and can be moved in response to an applied voltage.

In the released MEM apparatus 10, the tensile stress in the various elements comprising tungsten including the beams 18 arises primarily from a difference in the coefficient of thermal expansion of the tungsten (about $4.5\times10^{-6}$° C.$^{-1}$) and the silicon substrate 12 (about $3\times10^{-6}$° C.$^{-1}$) as the substrate 12 cools down from the tungsten deposition temperature of about 400° C. to room temperature. In elements of the apparatus 10 which are free to move, this tensile stress can be relaxed in one or more directions. In other elements such as the beams 18, which are pinned to the substrate 12, there can be a relatively large tensile stress on the order of 1 gigaPascal.

This large built-in tensile stress in the tungsten prevents the blanket deposition of a relatively thick (≧1 μm) tungsten layer and patterning of the tungsten layer by subtractive etching since the blanket deposition of a tungsten layer this thick would bow the silicon substrate 12 to an extent that would prevent further processing. Therefore, a damascene process as described in FIGS. 8A-8H is used to provide stress compensation during fabrication of the MEM apparatus 10.

Figure 9:
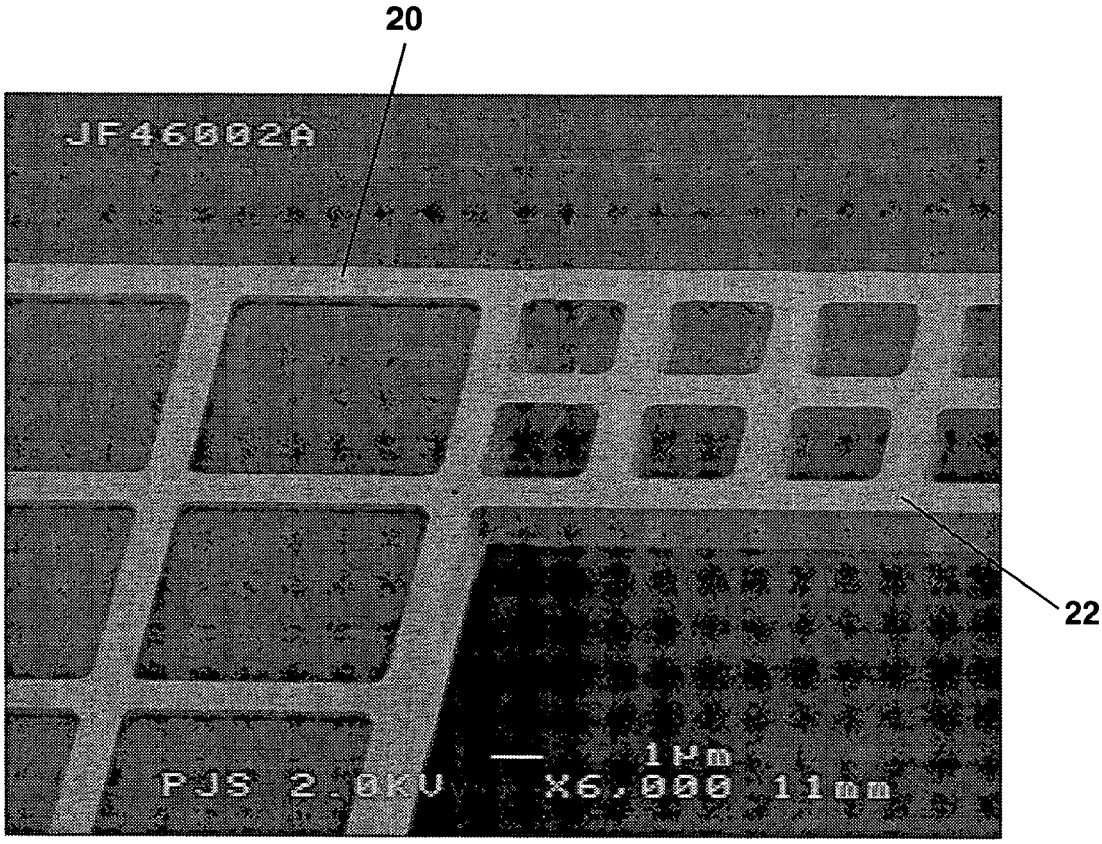
FIG. 9 shows an enlarged image of a portion of the device of FIG. 7 to illustrate a contact pad formed with a filled mesh structure and supported above the substrate, and an attached electrode formed with an open mesh structure and suspended over the substrate.

This damascene process also allows the fabrication of relatively large plates (e.g. for the shuttle 14 or contact pads 20) having a mesh structure of arbitrary size and shape, and with the mesh structure being either open or closed (i.e. filled). The mesh structure can be produced a plurality of spaced-apart trenches (i.e. openings 34) intersecting at 90° as shown by an enlarged image of one of the contact pads 20 and attached electrode 22 in FIG. 9. The light-colored areas in FIG. 9 are tungsten which has been deposited as previously described with reference to FIGS. 8D and 8E in a plurality of 90°-intersecting trenches which are 0.8 μm wide and 2 μm deep, and with adjacent parallel trenches being separated by 2.4 μm for the electrode 22 and 5.6 μm for the contact pad 20. In general, for deposition of the tungsten by CVD at 400° C., the trenches can be up to about 2 μm wide with an aspect ratio of height to width being in a range of about 1:1 to 5:1. The dark colored areas in the contact pad 20 in FIG. 9 are silicon nitride which fills in the mesh structure of the contact pad 20 to anchor the pad 20 to the substrate 12 and provide electrical insulation therebetween. In FIG. 9, the electrode 22 extends outward from the contact pad 20 and is suspended above the substrate 12 as a cantilever. The shuttle 14 can likewise comprise a mesh structure which has been filled in with a material such as silicon nitride or alternately polysilicon.

An optional layer (not shown) of metal (e.g. aluminum, tungsten, platinum, gold, etc.) about 200-300 nanometers thick can also be deposited over each contact pad 20, and over other elements of the MEM apparatus 10 including the shuttle 14. When tungsten is used to form this optional layer, a layer of TiN about 50 nanometers thick can be used initially deposited to improve adhesion of the tungsten. The electrically-contacting sidewalls of each electrode 22 and 24 can also be optionally overcoated with a metal layer by depositing the metal with the substrate 12 tilted at an angle (e.g. ±450).

Figure 10:
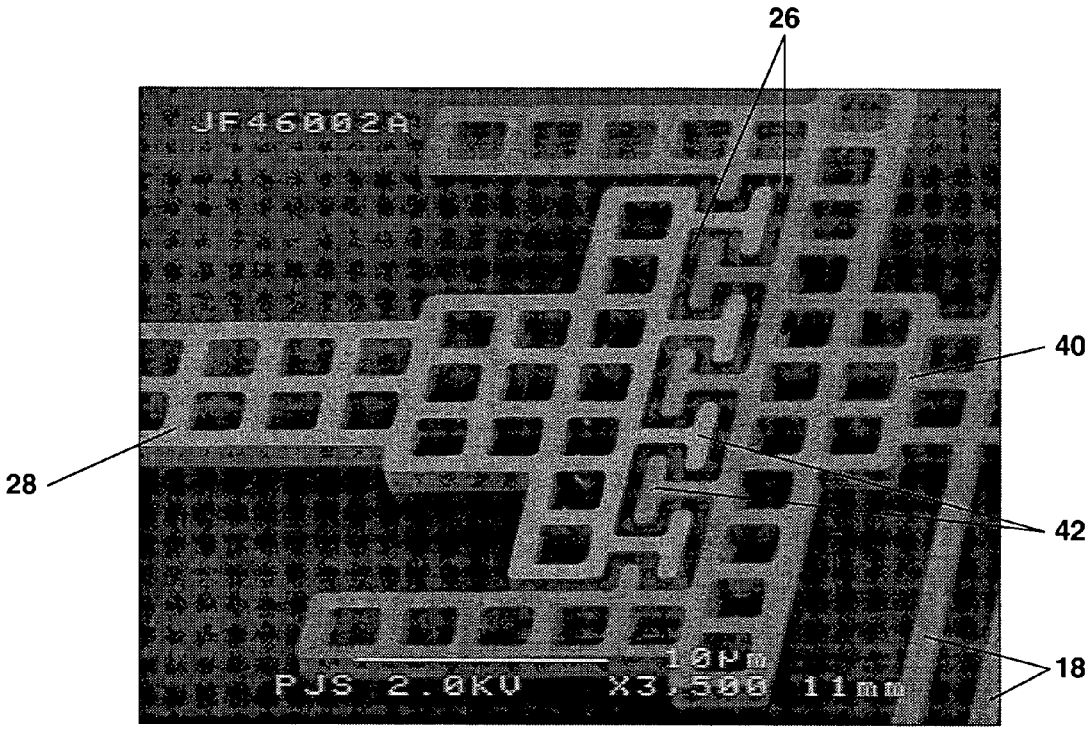
FIG. 10 shows an enlarged image of a portion of the device of FIG. 7 to illustrate the formation of a mechanically strong, electrically-insulated connection between each set of tensile-stressed beams and the linkage.

FIG. 10 shows an enlarged image of a portion of the device 10 of FIG. 7 to illustrate how the damascene process can be used to form an electrically-insulated but mechanically strong connection between each set of tensile-stressed beams 18 and the linkage 28. In FIG. 10, a plurality of tensile-stressed beams 18 are connected to a central truss 40 which, in turn, is connected to the linkage 28 through an electrically-insulated spacer 26. To strengthen this connection between the central truss 40 and the linkage 28, a plurality of interlocking T-shaped extensions 42 can be provided on both the truss 40 and linkage 28 as shown in FIG. 10, with an electrically-insulating material such as silicon nitride being disposed therebetween to form the electrically-insulated spacer 26.

When silicon nitride is used to form the electrically-insulated spacer 26, a rectangular opening 34 can be etched into the layers 30 and 32 of the thermal oxide and PETEOS, respectively, at the location where the electrically-insulated spacer 26 is to be formed. Silicon nitride can then be deposited to fill in the rectangular opening using plasma-enhanced chemical vapor deposition (PECVD) at a temperature of 350-400° C., and any of the silicon nitride outside the rectangular opening 34 can be removed by etching or CMP. A plurality of T-shaped openings can then be etched into the silicon nitride in the rectangular opening. Titanium nitride and tungsten can then be deposited in the T-shaped openings as previously described with reference to FIGS. 8B-8E to form the plurality of T-shaped extensions 42. The silicon nitride used to form the electrically-insulating spacer 26 is substantially impervious to chemical attack by the selective wet etchant and will be retained in place after the layers 30 and 32 have been removed to complete fabrication of the device 10. The tensile stress provided by the beams 18 puts the silicon nitride electrically-insulated spacer 26 in compression due to interlocking of the T-shaped extensions 42.

The various examples of the present invention in FIGS. 1, 3 and 7 can also be fabricated using silicon nitride as the tensile-stressed material. The tensile-stressed silicon nitride can be formed by thermal CVD (i.e. without a plasma) at a relatively high deposition temperature of about 800° C. and with a generally stoichiometric composition (i.e. $Si_3N_4$). When this is done, the tensile stress in the silicon nitride arises during cooling down to room temperature since the thermal expansion coefficient for silicon nitride (about $4\times10^{-6}$° $C.^{-1}$) is about one-third larger than that of the silicon substrate 12. There is also built-in stress arising from the deposition process itself.

Since the silicon nitride is not electrically conductive, the tensile-stressed beams 18, contact pads 20, central truss 40 and other elements of the MEM apparatus 10 requiring electrical conductivity can be formed with a composite structure that comprises an electrically-conductive material such as doped polysilicon superposed with the silicon nitride. This is schematically illustrated in FIG. 11 which shows a cross-section view of a tensile-stressed beam 18 comprising an outer portion 44 formed of silicon nitride, and an inner portion 46 comprising the electrically-conductive material.

Figure 11:
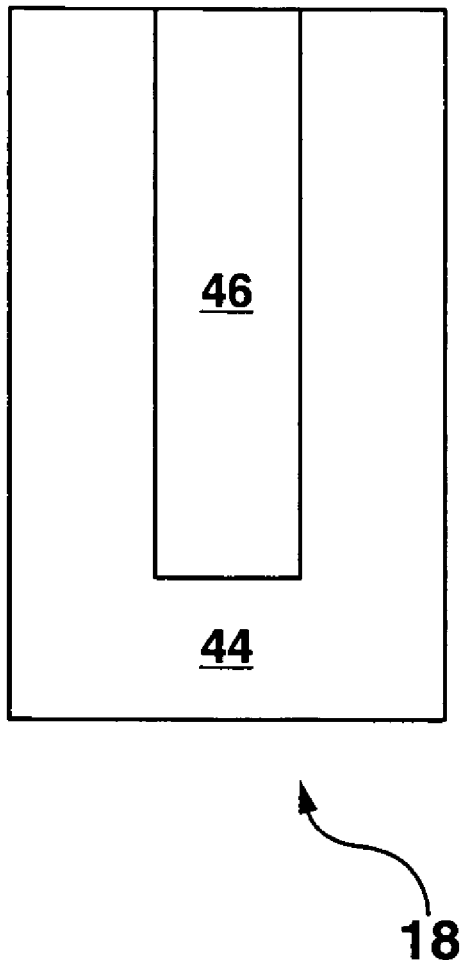
FIG. 11 shows a schematic cross-section view of a tensile-stressed beam formed with an outer portion of tensile-stressed silicon nitride and an inner portion of electrically-conductive polysilicon.

To form the composite structure of FIG. 11 with a width of, for example, 1.2 μm and a depth of 3 μm, about 400 nanometers of silicon nitride can be initially deposited by thermal CVD at about 800° C. to blanket the substrate 12 and to line the openings 34 shown in FIG. 8B. The remaining space in each opening 34 can then be filled with polysilicon which has been doped for electrical conductivity with an impurity dopant such as phosphorous or boron. The polysilicon can be blanket deposited at a temperature of about 580° C. using low pressure chemical vapor deposition (LPCVD) and annealed later to at least 800° C. to activate the impurity dopant. Any of the silicon nitride and polysilicon extending outside the openings 34 can be removed by CMP to complete the inner portion 46. This process can be repeated as needed to build up additional layers of the composite structure of the tensile-stressed beams 18 and other elements of the MEM apparatus 10 which must be electrically conductive.

For elements of the MEM apparatus 10 which do not need to be electrically conductive, the openings 34 in FIG. 8B can be completely filled with deposited silicon nitride. This can be done, for example, by making the openings 34 for these elements narrower (e.g. 0.6 μm wide) so that the thermal CVD deposition of silicon nitride completely fills in the openings 34. Then, any subsequently-deposited polysilicon will lie completely outside the narrower openings 34 and will be removed during the CMP step. This allows the use of a single mask to define both the non-conducting elements and the electrically-conducting elements in each layer of the MEM apparatus 10, simply by controlling the opening size for the conducting and non-conducting elements.

The use of doped polycrystalline silicon as the electrically-conductive material will increase the resistivity as compared with tungsten. This will allow the use of a lower current and higher voltage for activation of the device 10. The polysilicon in adjacent stacked layers having the composite structure of FIG. 11 can also be electrically connected in parallel or in series. This can be done by etching openings down through each subsequently-deposited silicon nitride outer portion 44 so that when the doped polysilicon inner portion 46 is deposited, it will fill in the openings and to form a series or parallel connection. To improve the electrical conductivity of certain elements (e.g. the shuttle 14, contact pads 20, electrodes 22 and 24, etc.) of the MEM apparatus 10, a metal layer can be deposited as described previously.

Figure 12:
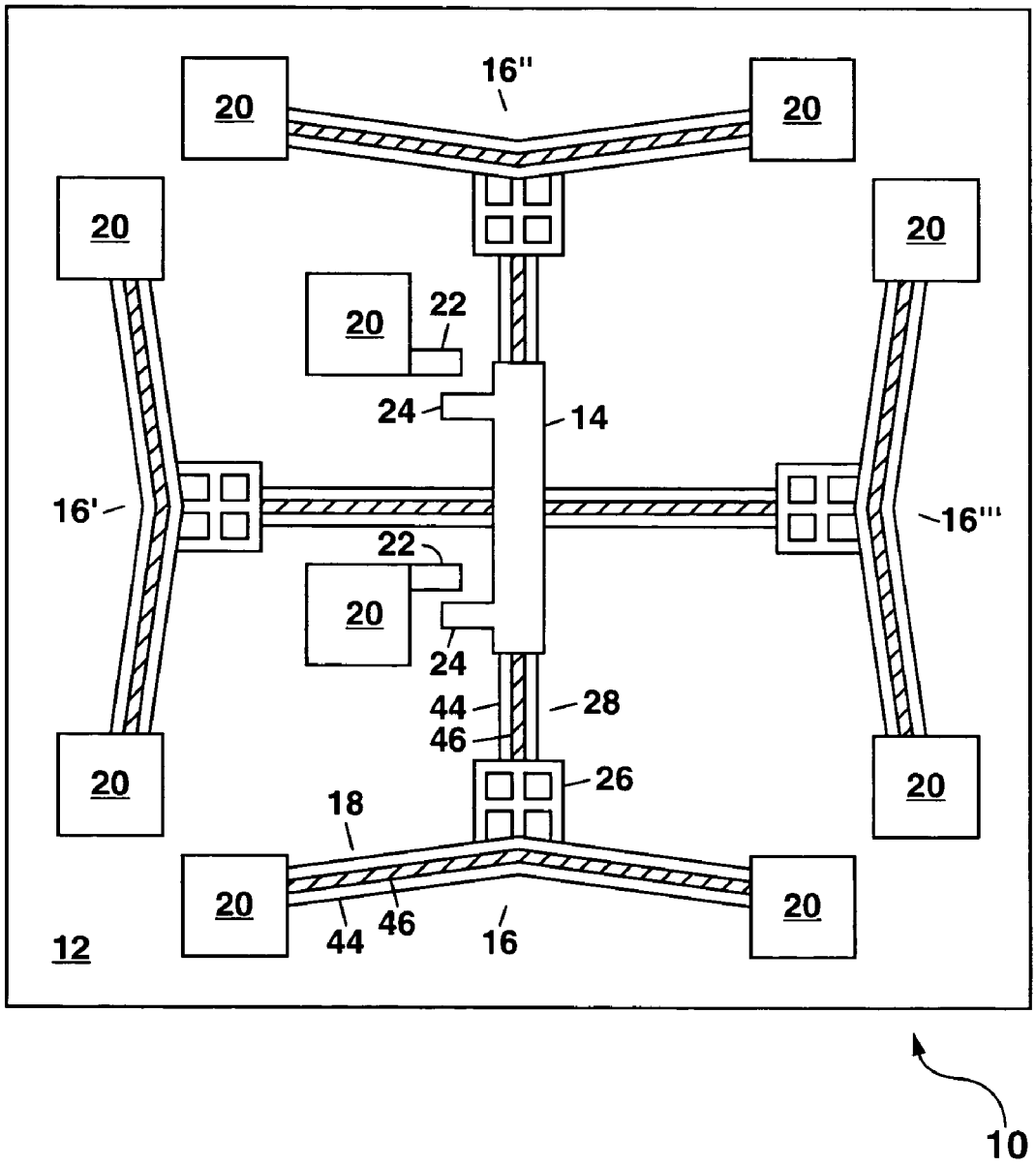
FIG. 12 shows a schematic plan view of a fourth example of the MEM apparatus of the present invention, with the tensile-stressed beams and linkages having a composite structure of silicon nitride and polysilicon, and with the shuttle, electrodes and contact pads comprising tungsten.

In other embodiments of the present invention, a combination of tensile-stressed silicon nitride and tensile-stressed tungsten can be used as schematically illustrated in a fourth example of the MEM apparatus 10 in FIG. 12. In this example, each set of tensile-stressed beams 18 and linkages 28 can be formed with a composite structure of polysilicon encased in silicon nitride as previously described with reference to FIG. 11. Other elements of the MEM apparatus such as the electrodes 22 and 24, the contact pads 20 and the shuttle 14 can be formed from tensile-stressed tungsten as previously described with reference to FIGS. 8A-8H. This provides a higher voltage and lower current for actuation of the device 10 due to the use of silicon nitride and polysilicon to form the tensile-stressed beams 18, while at the same time providing a higher electrical conductivity for the shuttle 14, electrodes 22 and 24 and contact pads 20 by using tungsten and titanium nitride for these elements. An optional coating of gold, aluminum or platinum can be provided over the shuttle 14, electrodes 22 and 24 and contact pads 20 to provide an even higher conductivity.

The device 10 of FIG. 12, which can be used as a latching relay, operates similarly to the device 10 of FIGS. 3 and 7 except that only a single pair of electrodes 24 are provided on the shuttle 14. In the device 10 of FIG. 12, the silicon nitride spacers 26 can have an open mesh structure as shown in FIG. 12. An open or closed mesh structure can also be used for the shuttle 14, contact pads 20, and electrodes 22 and 24.

The various examples of the MEM apparatus 10 of the present invention can, in some instances, be fabricated on a substrate 12 containing complementary metal-oxide-semiconductor (CMOS) integrated circuitry. This can be done by forming the CMOS integrated circuitry first using a series of processes well known in the art. A passivation layer (e.g. comprising PECVD silicon nitride) can be formed over the CMOS integrated circuitry prior to forming the MEM apparatus 10. This passivation layer, which has a low level of stress due to the relatively low PECVD deposition temperature of 350-400° C., can also be used to protect the CMOS integrated circuitry during the selective wet etching step used to remove the sacrificial material and release the MEM apparatus 10 as described with reference to FIG. 8H.

During fabrication of the MEM apparatus 10, electrical vias can be etched down through the passivation layer to form electrical interconnections between the CMOS integrated circuitry and the MEM apparatus 10, as needed. The CMOS integrated circuitry can be used to provide actuation voltages for operation of the MEM apparatus 10, to provide or receive signals that are switched by the MEM apparatus 10, or a combination thereof.

In general, devices 10 fabricated from CVD-deposited tungsten and including PECVD silicon nitride electrically-insulating spacers 26 will be compatible with back-end-of-line processing after first fabricating CMOS circuitry on the substrate 12 due to the relatively low temperatures of ≦400° C. On the other hand, devices 10 formed with a composite thermal CVD silicon nitride and LPCVD polysilicon structure will generally not be back-end-of-line CMOS compatible due to the much higher temperatures for deposition of the LPCVD polysilicon (580° C.) and subsequent annealing thereof (≧800° C.), and for deposition of the thermal CVD silicon nitride (800° C.).

Yet other materials can be used to form the tensile-stressed beams 18 in the various examples of the MEM apparatus 10 described herein. As an example, silicon carbide, which can be doped for electrical conductivity can be substituted for tungsten or the silicon nitride/polysilicon composite structure in forming the tensile-stressed beams 18 and other elements of the MEM apparatus 10.

The matter set forth in the foregoing description and accompanying drawings is offered by way of illustration only and not as a limitation. In other embodiments of the present invention, the electrodes 22 and 24 can be omitted from the MEM apparatus 10, and the shuttle 14 can be used simply as a stage which can be moved in two dimensions over a range of up to several tens of microns or more. Such a moveable stage device could be used, for example, for microscopy (e.g. atomic force microscopy). The actual scope of the invention is intended to be defined in the following claims when viewed in their proper perspective based on the prior art.

What is claimed is:

1. A microelectromechanical (MEM) apparatus, comprising:

(a) a substrate; and (b) a shuttle comprising a mesh structure and being suspended above the substrate by a plurality of sets of tensile-stressed beams located on at least two sides of the shuttle and operatively connected thereto, and with the shuttle being pulled in a direction substantially parallel to the substrate in response to a tensile stress in an unheated first set of the tensile-stressed beams on one side of the shuttle upon heating a second set of the tensile-stressed beams on an opposite side of the shuttle and thereby reducing the tensile stress therein.

2. The MEM apparatus of claim 1 wherein one end of each tensile-stressed beam is operatively connected to the shuttle, and an opposite end of each tensile-stressed beam is anchored to the substrate.

3. The MEM apparatus of claim 1 wherein the substrate comprises silicon.

4. The MEM apparatus of claim 1 wherein the shuttle comprises a metal.

5. The MEM apparatus of claim 4 further comprising at least one electrode supported on the substrate, with the shuttle being moveable to contact the at least one electrode to provide an electrical connection thereto in response to the second set of the tensile-stressed beams being heated to reduce the tensile stress therein.

6. The MEM apparatus of claim 5 further comprising a latch to maintain the electrical connection.

7. The MEM apparatus of claim 1 wherein each tensile-stressed beam comprises tungsten.

8. The MEM apparatus of claim 7 wherein each tensile-stressed beam further comprises titanium nitride.

9. The MEM apparatus of claim 1 wherein each tensile-stressed beam comprises silicon nitride.

10. The MEM apparatus of claim 9 wherein each tensile-stressed beam further comprises polycrystalline silicon.

11. The MEM apparatus of claim 1 wherein heating the second set of the tensile-stressed beams is produced by a flow of an electrical current therein.

12. The MEM apparatus of claim 1 wherein each set of the tensile-stressed beams is electrically isolated from the shuttle by an electrically-insulating spacer disposed therebetween.

13. The MEM apparatus of claim 12 wherein the electrically-insulating spacer comprises silicon nitride.

14. A microelectromechanical (MEM) apparatus comprising;

(a) a substrate; and (b) a shuttle having a mesh structure and being suspended above the substrate by a plurality of sets of tensile-stressed beams located on at least two sides of the shuttle and operatively connected thereto, and with the shuttle being moveable in a direction substantially parallel to the substrate in response to a tensile stress in a first set of the tensile-stressed beams on one side of the shuttle upon heating a second set of the tensile-stressed beams on an opposite side of the shuttle and thereby reducing the tensile stress therein.

15. The MEM apparatus of claim 14 wherein a plurality of openings in the mesh structure are filled with a material.

16. The MEM apparatus of claim 15 wherein the material comprises silicon nitride or polycrystalline silicon.

17. A microelectromechanical (MEM) apparatus, comprising:

(a) a substrate;

(b) a pair of electrodes supported on the substrate; and (c) an electrically-conductive shuttle comprising a mesh structure and being suspended above the substrate by a plurality of sets of tensile-stressed beams operatively connected to the shuttle, with each set of tensile-stressed beams operatively connected to a different side of the shuttle, and with the shuttle being moveable in a direction parallel to the substrate to electrically contact the pair of electrodes in response to a reduction in tensile stress in a first set of the tensile-stressed beams upon heating with an electrical current.

18. The MEM apparatus of claim 17 wherein each tensile-stressed beam comprises tungsten or silicon nitride.

19. The MEM apparatus of claim 18 further comprising a latch for holding the electrically-conductive shuttle in contact with the pair of electrodes.

20. The MEM apparatus of claim 19 wherein the latch is operable to hold the electrically-conductive shuttle in contact with the pair of electrodes by heating a second set of the tensile-stressed beams to reduce the tensile stress therein.

21. The MEM apparatus of claim 19 wherein the latch is operable to release the electrically-conductive shuttle from contact with the pair of electrodes by heating a third set of the tensile-stressed beams to reduce the tensile stress therein.

22. The MEM apparatus of claim 17 wherein each set of the tensile-stressed beams is electrically isolated from the shuttle by an electrically-insulating spacer located therebetween.

* * * * *